United States Patent [19]

Logan et al.

[11] Patent Number: 4,744,718

[45] Date of Patent: May 17, 1988

[54] AIRCRAFT SERVICE VEHICLE

[75] Inventors: Christopher T. Logan; Albert Barton; William Cottrell; William Mitchell, all of Victoria, Australia

[73] Assignee: Gleason Cranes (Vic.) Pty. Ltd., Victoria, Australia

[21] Appl. No.: 708,179

[22] Filed: Mar. 5, 1985

[30] Foreign Application Priority Data

Mar. 6, 1984 [AU] Australia ..... PG3926

[51] Int. Cl.[4] ..... B66C 23/00

[52] U.S. Cl. ..... 414/724; 414/728; 182/2; 280/490 R

[58] Field of Search ..... 414/685, 697, 712, 723, 414/728, 724, 706, 707, 710, 711, 713, 743; 280/490 R, 490 A, 479 R, 479 A, 759, 515, 460 R, 498; 212/267, 264, 230; 254/386; 182/2

[56] References Cited

U.S. PATENT DOCUMENTS

| | | | |
|---|---|---|---|
| 2,220,267 | 11/1940 | Nelson | 414/706 |
| 2,485,334 | 10/1949 | Terry | 280/498 X |
| 2,606,417 | 8/1952 | Richey | 414/685 X |
| 2,707,114 | 4/1955 | Martin | 280/498 X |
| 2,852,274 | 9/1958 | Seiley | 280/496 X |
| 3,010,735 | 11/1961 | Larsen | 280/496 X |
| 3,018,011 | 1/1962 | Ackermann | 414/711 |
| 3,367,441 | 2/1968 | Schuster et al. | 280/759 X |
| 3,432,184 | 3/1969 | Tweedy | 280/479 R |
| 3,687,484 | 8/1972 | Cosby | 280/759 X |
| 3,854,542 | 12/1974 | Jesswein et al. | 280/479 R X |
| 3,937,339 | 2/1976 | Geis et al. | 414/718 X |
| 3,967,744 | 7/1976 | Goyarts | 414/707 |
| 4,013,182 | 3/1977 | Pratt et al. | 414/723 |
| 4,119,225 | 10/1978 | Macht et al. | 414/723 |
| 4,142,709 | 3/1979 | Giessler | 254/386 |
| 4,208,163 | 6/1980 | Holmquist | 414/723 |
| 4,242,900 | 1/1981 | Dixon | 414/743 X |
| 4,360,216 | 11/1982 | Wiemers | 280/479 R |
| 4,382,743 | 5/1983 | Newell | 414/728 X |
| 4,391,562 | 7/1983 | Hetzner | 280/490 R X |
| 4,488,850 | 12/1984 | Wernimont | 414/723 |
| 4,506,480 | 3/1985 | Murrill et al. | 182/2 X |
| 4,542,913 | 9/1985 | Geisman | 280/490 R X |
| 4,553,899 | 11/1985 | Magni | 414/718 X |
| 4,586,867 | 5/1986 | Stafford | 414/723 |

FOREIGN PATENT DOCUMENTS

| | | | |
|---|---|---|---|
| 0496757 | 11/1950 | Belgium . | |
| 1001548 | 10/1952 | France | 280/496 |
| 568025 | 3/1945 | United Kingdom | 280/490 R |
| 830417 | 3/1960 | United Kingdom | 280/498 |
| 2040847 | 9/1980 | United Kingdom . | |

*Primary Examiner*—Robert J. Spar
*Assistant Examiner*—Jennifer Doyle
*Attorney, Agent, or Firm*—Buell, Ziesenheim, Beck & Alstadt

[57] ABSTRACT

A support vehicle particularly for use with aircraft wherein the vehicle, in a non-operative mode is maintained at low overall height and size for ease of transport and storage but includes an extendable main boom having attachment means at its free end enabling a plurality of different service facilities to be releasably secured thereto and a pivotable draw bar and hitch assembly enabling the hitch assembly to be operable at a plurality of different heights.

5 Claims, 5 Drawing Sheets

AIRCRAFT SERVICE VEHICLE

The present invention relates to a service vehicle particularly for use with aircraft.

A wide variety of different service or support vehicles are currently used to carry out such individual tasks as aircraft towing, engine changeover and other servicing tasks, loading and unloading of aircraft, and other general maintenance work to aircraft and airport facilities. Apart from the obvious costs of separately maintaining such diverse service vehicles, there is also a major problem in servicing aircraft in the field, i.e. in hazardous terrain where service vehicles must be transported to the site of intended use. There is therefore a need to provide one service and support vehicle which, together with suitable attachments, is capable of carrying out a number of different support and maintenance tasks while still being easily transportable (preferably by air). The objective of the present invention is therefore to provide one service and support vehicle having the capability of carrying out a number of different functions while maintaining a size and configuration suitable for ease of transport.

Accordingly, the present invention provides a support vehicle including a chassis having forward and rear ends supported on ground engaging wheels, an extendable boom pivoted at said rear end of said chassis to an upwardly extending support means connected to the vehicle chassis, the pivot connection of said extendable boom to the support means being located such that in a first lowered position the boom extends forwardly closely adjacent to an operator's control cabin supported on said chassis and in a second raised position the boom extends upwardly from the pivot connection, said extendable boom carrying connection means enabling a plurality of separate service implements to be selectively connected thereto, said vehicle including towing means located rearwardly of said vehicle, said towing means including a draw bar pivotably connected to said chassis intermediate its forward and rear ends whereby the draw bar is pivotable by actuating means between lower and upper positions adjacent the rear end of the vehicle chassis.

The arrangement of the boom in its lowermost position such that it is essentially disposed in a substantially horizontal manner closely adjacent the operator's control cabin ensures that the overall height of the vehicle is kept to a minimum when it is disposed in a non-operative condition. This provides significant assistance in transporting the vehicle, especially by air where occupied space must be minimized. Moreover, the provision for selective attachment of a variety of service implements to the extendable boom provides greater flexibility of use of the vehicle and means that separate vehicles are not required for separate tasks. Finally, the arrangement of the adjustable height draw bar ensures flexibility of operation in that it is possible to tow aircraft of varying configurations with the same service vehicle. Preferably, the rear end of the drawbar also carries a hitch means including a mechanism adapted to ensure the hitch means moves in a substantially vertical plane upon said draw bar moving between said lower and upper positions.

According to a second aspect of the present invention there is provided a support vehicle having a chassis supported on ground engaging wheels, an extendable boom pivoted at said rear end to an upwardly extending support means connected to the vehicle chassis, the pivot connection of said extendable boom to the support means being such that in a first lower position, the boom extends forwardly closely adjacent to an operator's control cabin supported on said chassis, and in a second raised position the boom extends upwardly from the pivot connection, said boom being extendable in either said first lower or second raised positions and carrying at its free end, means to enable plurality of separate service facilities to be attached thereto. Conveniently, in a first arrangement of the aforementioned aspect of the invention, a lifting and transport device is attached to the free end of the boom, said lifting and transport device enabling both vertical and horizontal movement of a support element relative to the free end of said boom. Preferably, said lifting and transport device comprises a frame adapted for attachment to said boom, said frame having a first leg formed in two parts such that said parts are longitudinally slidable relative to each other, a first pulley mounted on one of said parts and a second pulley mounted on the other of said parts, a flexible cable secured relative to one of said parts of the first leg and led over both said pulleys such that its free end depends below said first leg and first operating means adapted to vary the spacing between said pulleys to lift or lower said free end of the flexible cable.

In a second preferred arrangement of the above described aspect, a fork support element is attached to the free end of said boom to enable both loading and unloading of goods from or into any desired location. In a third preferred arrangement of the above described aspect, a work support platform carried by an independently extendable boom means is attached to the free end of the boom of the vehicle, said independently extendable boom means being adapted to elevate the work support platform to enable service tasks to be carried out from the work support platform.

According to a third aspect of the present invention there is provided a lifting and transport device comprising a frame, said frame having a first leg formed in two parts such that said parts are longitudinally slidable relative to each other, a first pulley mounted on one of said parts and a second pulley mounted on the other of said parts, a flexible cable secured relative to one of said parts of the first leg and led over both said pulleys such that its free end depends below said first leg and first operating means adapted to vary the spacing between said pulleys to lift or lower said free end of the flexible cable. Preferably, one of the pulleys is mounted for sliding movement relative to the part of said leg to which said pulley is mounted. Conveniently, second operating means is provided adapted to move said leg parts relative to each other.

Further preferred aspects of the present invention will become apparent from the following description of preferred embodiment illustrated in the accompanying drawings. In the drawings:

FIG. 1 is a side elevation view of an embodiment of a service and support vehicle according to the present invention with one form of service facility connected to the boom of the vehicle;

FIG. 1*a* is a view similar to FIG. 1 of the boom carrying a second form of service facility;

FIG. 1*b* is a view similar to FIG. 1*a* showing a third form of service facility connected to the boom;

FIG. 2 is a side elevation detailed view of the service facility shown schematically in FIG. 1*a;*

FIG. 2*a* is a section view along line A—A of FIG. 2;

Figures 1B, 2A, 4A, 4B:
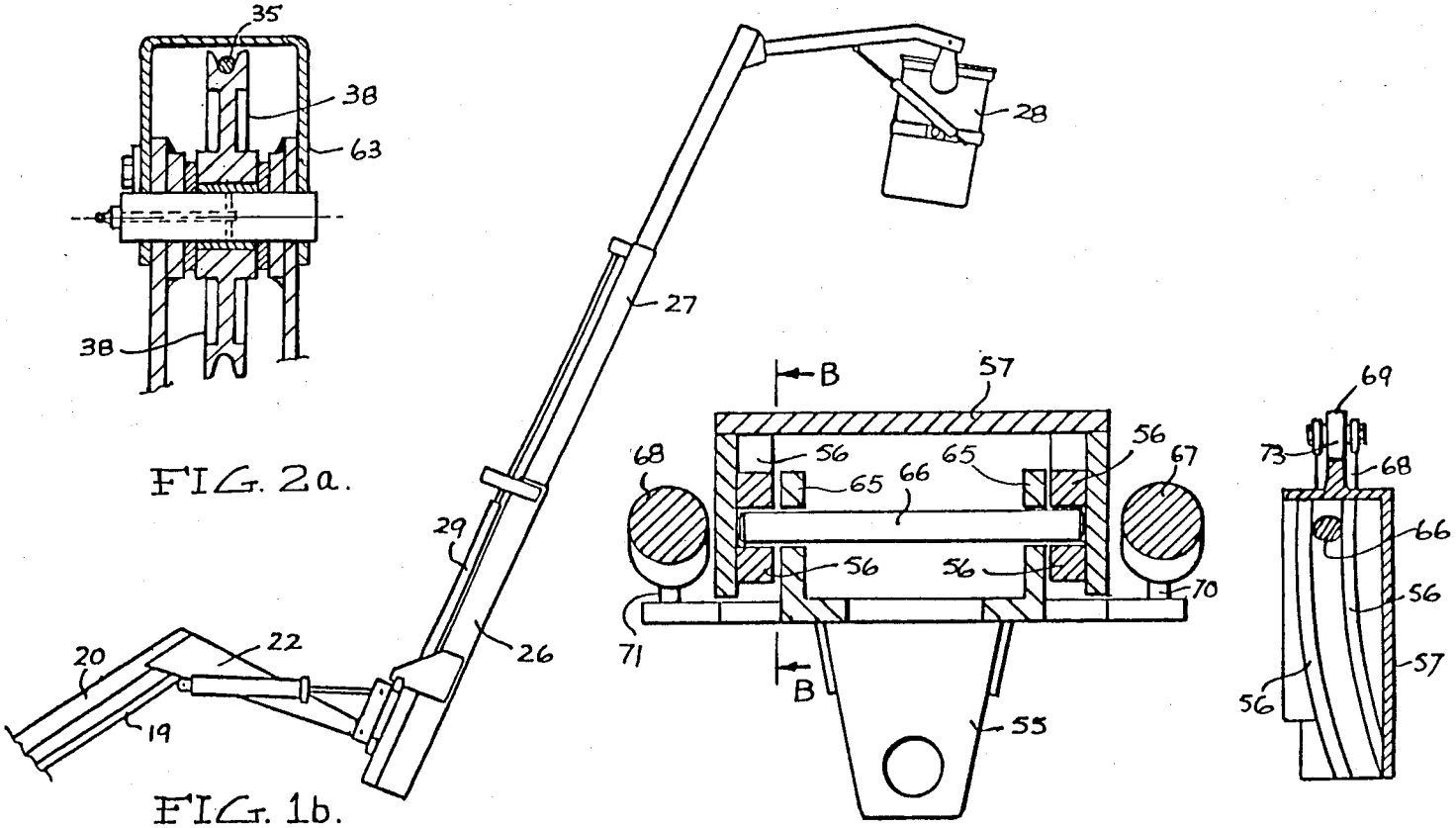
FIG. 4 is a side elevation view of the towing means shown generally in FIG. 1.
Figure 5:
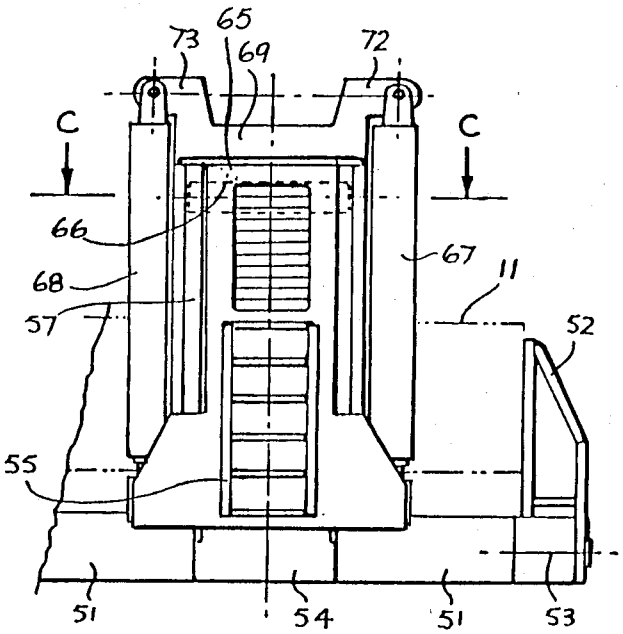
FIG. 5 is an end elevation view of the towing means shown in FIG. 4.

FIG. 4*a* is a section view taken along line A—A of FIG. 5; and

FIG. 4*b* is a section view taken along line B—B of FIG. 4*a*.

Figure 1A:
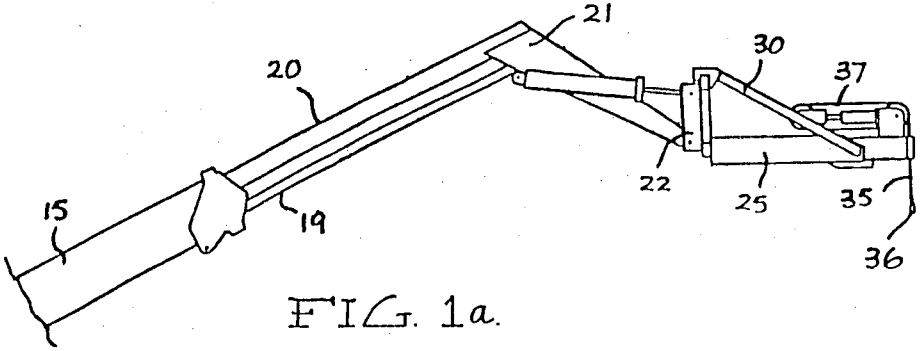
Figure 1:
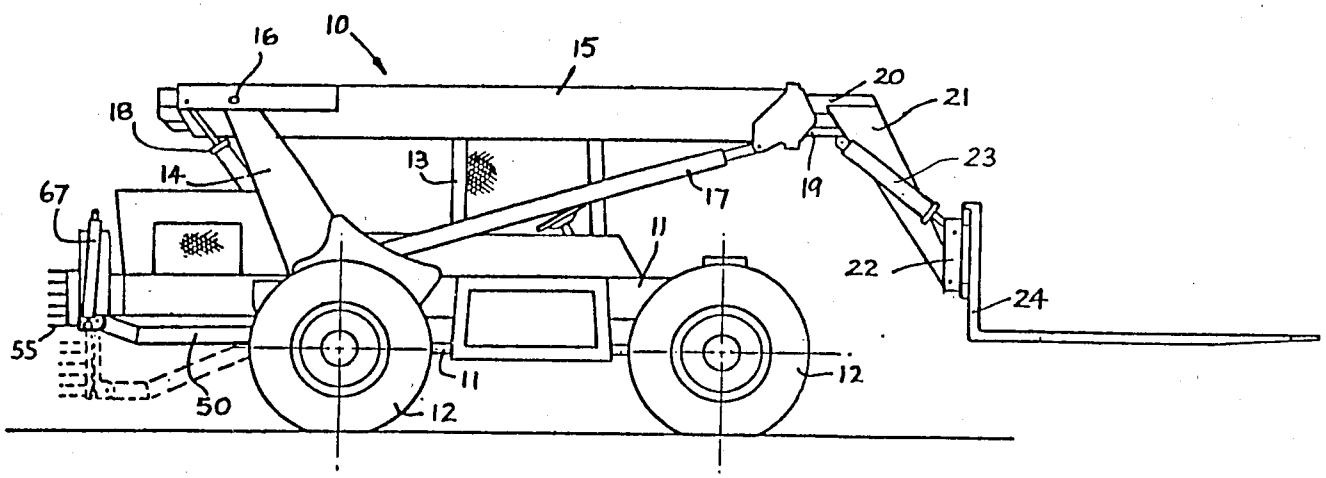

Referring now to FIG. 1, there is shown a support and servicing vehicle 10 preferably for use with aircraft. The vehicle 10 includes a chassis 11 supported by ground engaging wheels 12. Preferably the construction power means and control of the vehicle is such that it is suitable for both on-road and off-road work. A control cabin 13 protected by suitable roll bar elements is provided on the vehicle chassis. Support means 14 are located rearwardly on the vehicle for pivotally connecting a main extendable boom 15 thereto for movement about a horizontal pivot axis 16. In the lowermost position and substantially horizontally closely adjacent to the top of the operator's control cabin 13 to minimise the overall height dimension of the vehicle for ease of transport. Hydraulic actuating rams 17,18 are provided for pivoting the boom 15 about the pivot axis 16 to raise or lower the boom as desired. As shown in FIG. 1*a*, the boom 15 is also extendable by a hydraulic actuating ram 19. The moving part 20 of the boom 15 carries at its forward or free end, a downwardly angled support member 21 with an attachment plate 22 pivotally connected to the free end of the support member 21. A hydraulic actuating ram 23 is provided to maintain the attachment plate 22 substantially vertical upon pivoting of the boom 15 about the axis 16. The attachment plate is arranged such that a pluralty of different service facilities may be attached thereto.

As shown in FIG. 1, a lifting and transporting fork arrangement 24 forms one service facility connectable to the attachment plate 22. Extension of the boom 15 enables the fork arrangement 24 to reach into and from storage regions such as truck compartments, aircraft loading zones and storage containers.

FIG. 1*a* shows a second form of service facility 25 attached to the attachment plate 22. The facility 25 provides for both horizontal and lifting movement and is described in more detail hereinafter with reference to FIGS. 2, 2*a* and 3. FIG. 1*b* shows a third form of service facility 26 attached to the attachment plate 22 of the boom 15. The facility 26 comprises an independently extendable mast or column 27 connected to the main boom 15 and carrying a work platform (basket) 28 at its free end. Conveniently, the extendable mast 27 is in three telescopic sections including internal means and an external actuating member 29 to raise or lower the work basket to any desired level for the carrying out of maintenance work.

Figure 2:
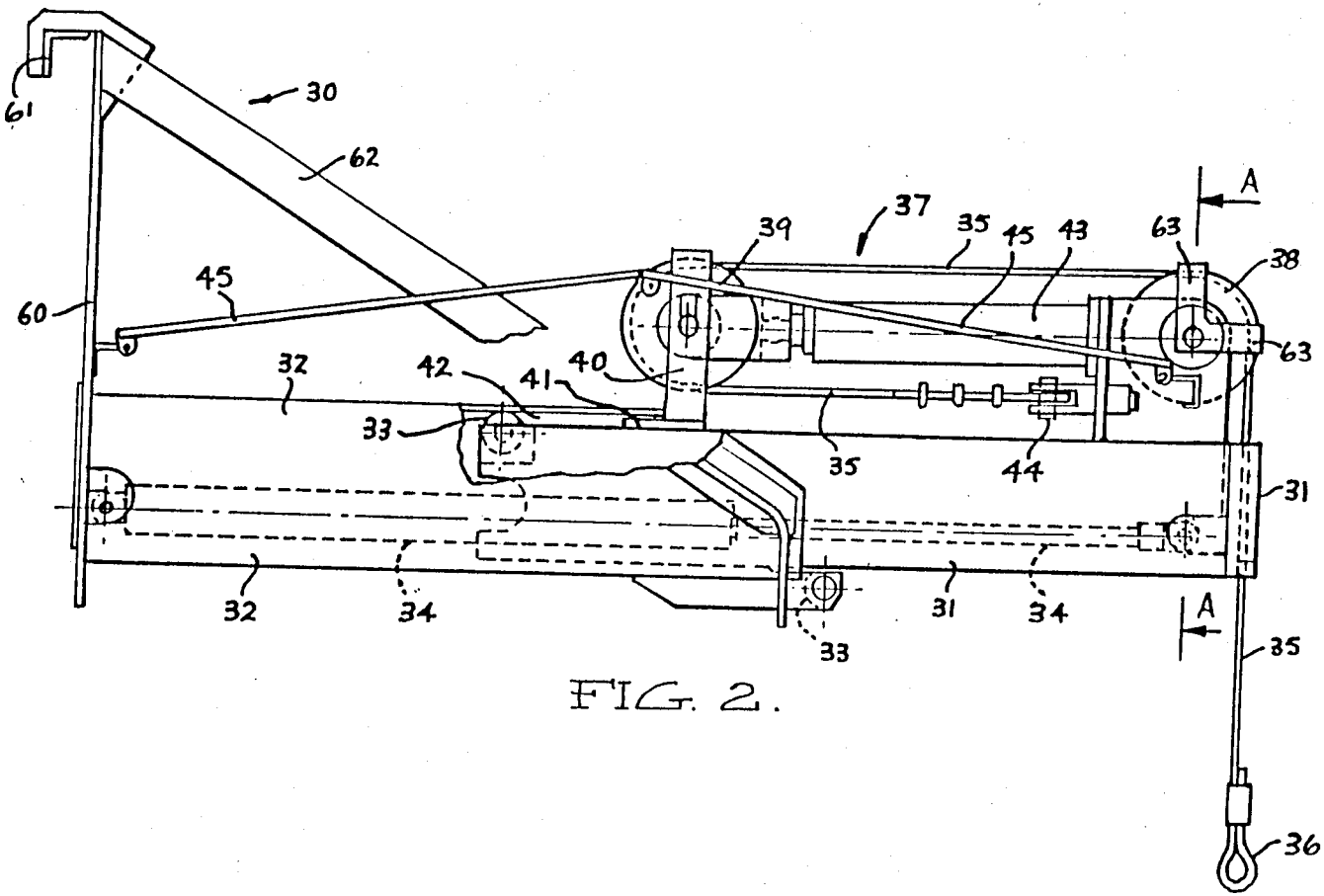
Figure 3:
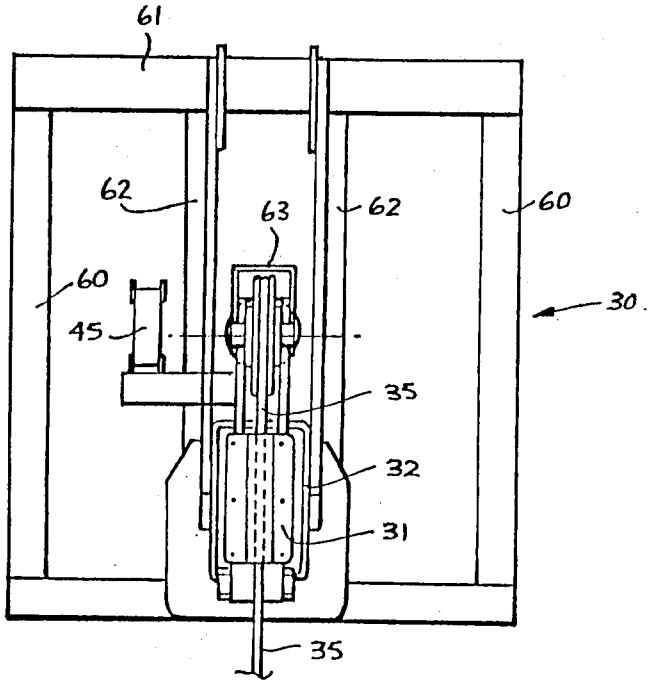
FIG. 3 is an end elevation view of the facility shown in FIG. 2.

Reference is now made to FIGS. 2, 2*a* and 3. There is illustrated (FIG. 2) a generally triangular support framework 30 which is adapted to be releasably connected to the attachment plate 22 of the boom 15. The support frame 30 comprises a substantially vertical framing section 60 adapted to connect to the attachment plate 22 of the boom 15. A U-shaped channel 61 is provided to fit over the upper edge of the attachment plate and further releasable connection means can be provided if desired. A lower base leg 32 is provided together with an angular brace 62 completing the support frame 30. A support leg 31 is provided connected to the support framework 30 but being slidable in a direction to extend the base leg 32 thereof. The sliding movement is assisted by the provision of rollers 33 between the legs 31 and 32. An hydraulic actuating member 34 is provided to effect the relative movement between the legs 31 and 32. A flexible lifting means (cable) 35 is provided supported by the legs 31,32 and having a free end 36 adapted to be connected to a lifting hook or the like to enable weights of desired dimension to be lifted thereby. A mechanism 37 is provided between the support framework 30 and the free end of the cable 36 to enable the elevation of the cable end 36 to be varied as it is moved horizontally by movement of the leg 31.

The mechanism 37 comprises a pulley 38 pivotally mounted at a fixed location to the free end of the leg 32 and a pulley 39 pivotally mounted on a slide mechanism for sliding movement relative to the leg 32 but restrained from movement laterally away therefrom. Conveniently, the mounting bracket 40 for the pulley 39 includes portions 41 restrained for movement within the gap 42 existing between the leg 31 and the leg 32. The gap 42 being established by the provision of the rollers 33. An actuating cylinder 43 is provided to selectably extend (or contract) the spacing between the pulleys 38 and 39. The cable 35 is rigidly fixed at a position 44 adjacent the pulley 38 and is led therefrom successively over the pulley 39 and the pulley 38 to drop downwardly therefrom. A protective bracket 63 surrounds the pulley 38 and the cable 35 passes downwardly through the end of the leg 31. In consequence, extension or contraction of the actuating cylinder 43 raises or lowers the cable end 36 as desired. A pivotable support 45 is provided to maintain the hydraulic cables (not shown) in position without fouling the mechanism 37.

As will be apparent from FIG. 2, if the relative spacing between the pulleys 38,39 is maintained fixed by means of the actuating cylinder 43, movement of the leg 31 outwardly or inwardly will similarly move the free end 36 of the cable 35. Such movement is achieved by actuation of the cylinder 34.

The mechanism 37 thus described provides the ability of accurately positioning a desired load by a combination of lateral and elevating movements and is particularly useful for lifting in or out, aircraft engines when it is desired to change over such an engine. Moreover, the apparatus 37 can be used as a generally lifting and transport facility by the use of the vehicle and main boom 15.

Figure 4:
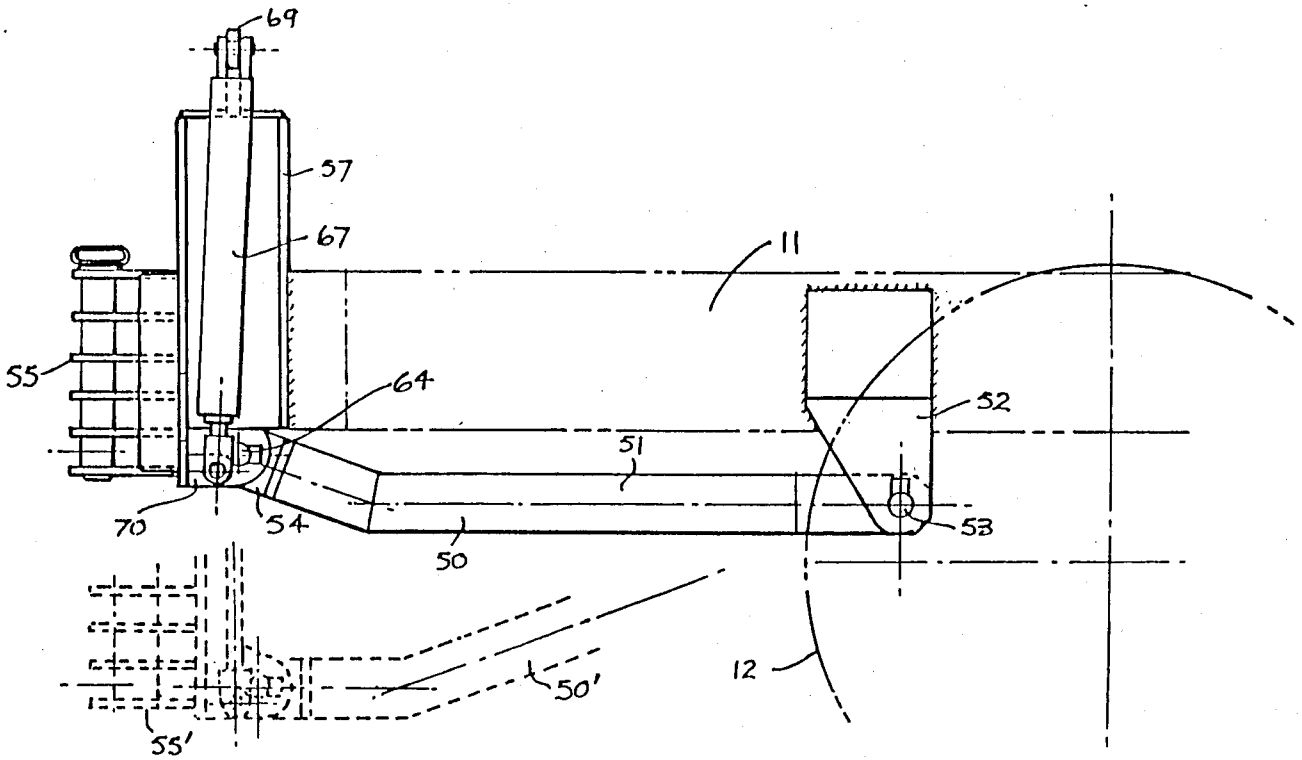

Reference is now made to FIGS. 1 and 4 to 5. As shown in FIG. 4, a draw bar 50 having an A configuration with spaced legs 51 pivoted at 53 to the chassis 11 of the vehicle at a position forward of the rear of the vehicle. Downwardly extending brackets 52 are provided for effecting the pivotal connection of the legs 51 to the chassis such that the draw bar pivots about a substantially horizontal axis 53. The free or rearward end 54 of the draw bar has a hitch element 55 pivotally connected thereto at 64 such that the hitch element extends upwardly therefrom. An upper end 65 of the hitch element 55 includes roller means 66 received within curved guide tracks 56 of a support bracket 57 fixed to the vehicle chassis. A pair of hydraulic actuating members 67, 68 are provided extending between an upper end 69 of the fixed support bracket 57 and the lower end of the hitch means 55 to effect raising or lowering of the hitch means and draw bar as desired. The lower end position of the hitch means is shown at 55′ in dotted outline in FIG. 4. The lower end of the cylinders 67, 68 are pivotally connected to brackets 70,71 on the hitch means and to spaced upper end regions 72,73 of the fixed support bracket 57. The raising and lowering of the draw bar is of importance in enabling transport of the vehicle as well as for towing of different aircraft.

We claim:

1. A support vehicle including a chassis having forward and rear ends supported on ground engaging wheels, an extendable boom pivoted at said rear end of said chassis to an upwardly extending support means connected to the vehicle chassis, the pivot connection of said extendable boom to the support means being located such that in a first lowered position the boom extends forwardly closely adjacent to an operator's control station supported on said chassis and in a second raised position the boom extends upwardly from the pivot connection, said extendable boom carrying connection means enabling a plurality of separate service implements to be selectively connected thereto, said vehicle including towing means located rearwardly of said vehicle, said towing means including a draw bar pivotally connected to said chassis intermediate its forward and rear ends whereby the draw bar is pivotable by actuating means between lower and upper positions adjacent the rear end of the vehicle chassis, said draw bar carrying hitch means located rearward of but adjacent to the rear end of the vehicle chassis, said hitch means defining a connection axis for connecting a towed vehicle to said support vehicle, said connection axis being substantially vertical when said support vehicle is on level ground, said hitch means including a mechanism comprising a fixed frame member connected to or forming part of said chassis, said frame member defining a pair of curved guide tracks, said hitch means being disposed between said guide tracks such that one lower end of said hitch means is pivotally connected to the rear end of said draw bar, and said hitch means carries guide members receivable in said guide tracks, whereby upon operation of said actuating means, said guide members slide along said guide tracks to ensure that said connection axis remains substantially vertical upon said draw bar moving between said lower and said upper positions.

2. A support vehicle according to claim 1 wherein a said service implement comprises a frame adapted for attachment to said connection means on said boom, said frame having a first leg formed in two parts such that said parts are longitudinally slidable relative to each other, a first pulley mounted on one of said parts and a second pulley mounted in a manner enabling movement only in the longitudinal direction of said parts and relative to both said parts, a flexible cable secured relative to one of said parts of the first leg and led over both said pulleys such that its free end depends below said first leg, first operating means adapted to vary the spacing between said pulleys to lift or lower said free end of the flexible cable, and second operating means operable independently of said first operating means to move said leg parts relative to one another without altering the spacing between said pulleys.

3. A support vehicle according to claim 1 wherein said service implement comprises a fork support element including releasable attachment means for joining the fork support element to the connection means at the free end of the boom.

4. A support vehicle according to claim 1 wherein said service implement comprises a work platform including releasable attachment means for joining the work platform to the free end of the boom.

5. A support vehicle according to claim 1 wherein said extendable boom comprises a main section pivotable to the support means and a second section slidable relative to said main section to extend the length of said boom, said second section having a free end with a downwardly directed support member and said connection means including an attachment plate pivotable to the free end of said support member, and second actuating means being provided to effect relative pivotable movement between said attachment plate and said support member.

* * * * *